US008960472B2

(12) United States Patent
Tomaru et al.

(10) Patent No.: US 8,960,472 B2
(45) Date of Patent: Feb. 24, 2015

(54) SEAMLESS CAN BODY

(75) Inventors: Hidekazu Tomaru, Yokohama (JP); Syouta Tanaka, Yokohama (JP); Hayato Fukumoto, Yokohama (JP); Toshiki Okuda, Yokohama (JP)

(73) Assignee: Toyo Seikan Kaisha, Ltd., Tokyo (JP)

( * ) Notice: Subject to any disclaimer, the term of this patent is extended or adjusted under 35 U.S.C. 154(b) by 0 days.

(21) Appl. No.: 13/702,716

(22) PCT Filed: May 25, 2011

(86) PCT No.: PCT/JP2011/061934

§ 371 (c)(1),
(2), (4) Date: Dec. 7, 2012

(87) PCT Pub. No.: WO2011/155329

PCT Pub. Date: Dec. 15, 2011

(65) Prior Publication Data

US 2013/0087561 A1 Apr. 11, 2013

(30) Foreign Application Priority Data

Jun. 8, 2010 (JP) ..... 2010-131138

(51) Int. Cl.
*B65D 8/04* (2006.01)
*B65D 1/16* (2006.01)
*B65D 25/14* (2006.01)

(52) U.S. Cl.
CPC ..... *B65D 1/165* (2013.01); *B65D 25/14* (2013.01)
USPC ..... 220/62.12; 220/62.11; 220/600; 220/604; 220/608; 220/609

(58) Field of Classification Search
USPC ..... 220/62.11, 62.12, 62.22, 600, 604, 606, 220/608, 609, 623
See application file for complete search history.

(56) References Cited

U.S. PATENT DOCUMENTS 3,905,507 A 9/1975 Lyu
4,431,112 A * 2/1984 Yamaguchi ..... 220/606
(Continued)

FOREIGN PATENT DOCUMENTS

EP 1 103 470 A1 5/2001
GB 2 119 743 A 11/1983
(Continued)

OTHER PUBLICATIONS

International Search Report of PCT/JP2011/061934, mailing date Aug. 23, 2011.

*Primary Examiner* — Jeffrey Allen
*Assistant Examiner* — Madison L Poos
(74) *Attorney, Agent, or Firm* — Westerman, Hattori, Daniels & Adrian, LLP

(57) ABSTRACT

A seamless can body in which the flatness of a center panel of a bottom of the thin can body can be stably maintained and the can body has high pressure resistance, high formability, and excellent properties for an internal pressure test. The seamless can body has a can bottom shape having a rim portion protruding to an outside of the can, an annular concave portion protruding to an inside of the can, and a flat center panel extending continuously from an inner peripheral side of the annular concave portion with a corner portion interposed therebetween. The curvature radius ($R_3$) of the corner section is in the range of 1.5 mm<$R_3$≤6.0 mm, the depth of the annular concave section is from 1.5 mm to less than 3.0 mm, and the flatness (BSD) of the center panel is from −0.15 to 0.15 mm.

5 Claims, 3 Drawing Sheets

(56) References Cited

U.S. PATENT DOCUMENTS

| | | | | |
|---|---|---|---|---|
| 5,593,063 | A | 1/1997 | Claydon et al. | |
| 2007/0119224 | A1 * | 5/2007 | Aoyagi et al. | 72/349 |

FOREIGN PATENT DOCUMENTS

| | | | |
|---|---|---|---|
| JP | 50-136181 | A | 10/1975 |
| JP | 55-048037 | A | 4/1980 |
| JP | 56-077038 | A | 6/1981 |
| JP | 61-043109 | U | 3/1986 |
| JP | 07-509428 | A | 10/1995 |
| JP | 11-193016 | A | 7/1999 |
| JP | 2000-016418 | A | 1/2000 |
| JP | 2009-173338 | A | 8/2009 |

* cited by examiner

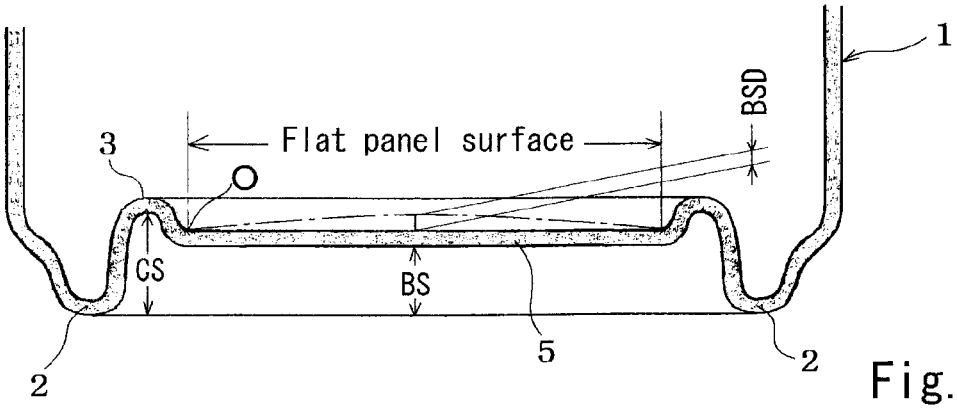
Fig. 1
Fig. 2
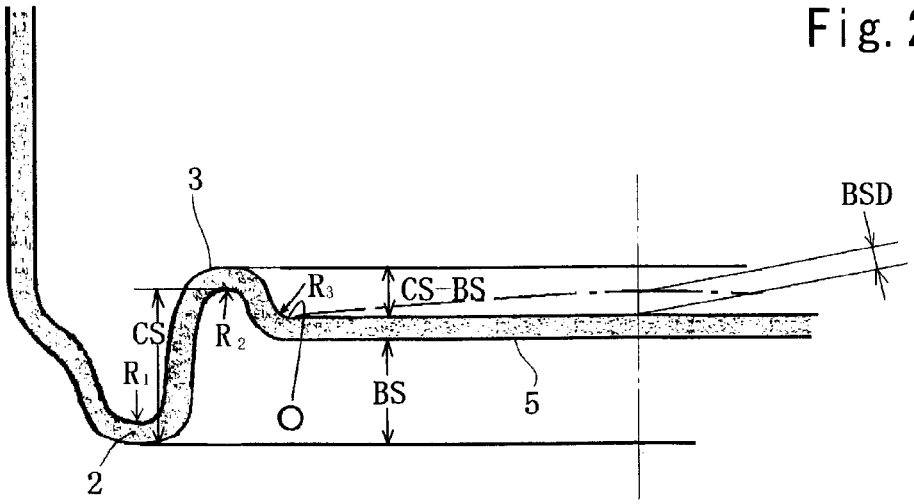

SEAMLESS CAN BODY

TECHNICAL FIELD

The present invention relates to a seamless can body and particularly to a seamless can body having a flat center panel at a can bottom.

BACKGROUND ART

Conventionally, employed in general as an internal pressure test method of a can filled with content such as a low-acid beverage, e.g., coffee and tea into the can and sealed are an internal pressure test method for testing whether an internal pressure is appropriate by measuring a displacement amount in the axial direction of a center panel of a negative-pressure can formed by forming the center panel of a can bottom of a seamless can body into a flat shape and filling content into the seamless can body and sealing the can body or a slightly-positive-pressure can formed by filling and sealing the can after replacing a head space with inert gas such as nitrogen in order to reduce thickness of the seamless can body or an internal pressure test method (called a tapping inspection) for testing whether internal pressure is appropriate by applying an electromagnetic shock to the center panel and measuring a tapping inspection sound (resonance frequency). It is known that, in these internal pressure tests of the can, the test can be carried out with higher accuracy when flatness of the center panel is high. Therefore, in a manufacturing process of the seamless can body, it is an important factor to increase the flatness of the center panel of the can bottom in order to obtain the seamless can body having excellent suitability for the internal pressure tests by the above-described internal pressure test methods and various contraptions for keeping the can bottom flat have been proposed conventionally.

As a seamless can body for positive pressure and having high pressure resistance in spite of use of thin-walled material and an aptitude for the tapping inspection, there is a known seamless can body including, on its can bottom, a rim portion protruding to an outside of the can, an inner wall portion rising from an inner peripheral side of the rim portion, an annular concave portion protruding to an inside of the can, and a flat center panel portion extending continuously from an inner peripheral side of the annular concave portion with a corner portion interposed therebetween (see Patent Document 1).

The flatness of the center panel is defined by a distance of outward or inward bulging of a center portion of the center panel with respect to an outer peripheral end of the center panel as a basis surface (referred to as "bottom sink difference (BSD)", in general). The BSD is influenced by characteristics of metal materials and various forming conditions and is also influenced, in a case of a seamless can body obtained by drawing/ironing or wall-thinning drawing (stretch drawing)/ironing, by assist air pressure for removing the can body from a punch after the ironing and therefore it is difficult to control the flatness in such a range that the can body can be adapted to the above-described inner pressure test (see Patent Document 2).

PRIOR ART DOCUMENT

Patent Document

Patent Document 1: JP 2000-16418 A
Patent Document 2: JP 56-77038 A

SUMMARY OF INVENTION

Problem to be Solved by the Invention

Normally, the can bottom of the seamless can body is formed by a punch and a bottom die corresponding to a shape of the can bottom at the time of the above-described ironing (when the ironing is finished). On the other hand, in the seamless can body disclosed in Patent Document 1 described above, a radius R of an inner curvature of the corner portion near the annular concave portion of the can bottom is formed to be as small as 0.5 mm to 1.5 mm. Therefore, an excessive tensile load is applied to the corner portion or a portion near the corner portion during forming of the can bottom by using the punch and the bottom die to cause constriction of thickness (decrease in thickness) at a portion in a circumferential direction of the corner portion and therefore the tensile load applied to the center panel becomes non-uniform in the circumferential direction. As a result, the flatness of the center panel is impaired and a decrease rate of the thickness of the annular concave portion increases to cause a crack or a cut. Such phenomena become noticeable especially when the seamless can body is made thin-walled.

On the other hand, in a seamless can body formed by using a covered metal plate obtained by covering a metal plate made of aluminum, tin, tin-free steel, or the like with a resin film made of polyester resin or the like, the resin film of the corner portion may be damaged due to a small radius of curvature of the corner portion. Especially when the damage is caused on the inner surface of the seamless can body, the content deterioration in flavor or corrosion or the like occurs due to exposure of a metal face.

The present invention has been made with these problems in the prior art in view and its object is to provide a seamless can body having suitability for the internal pressure test, excellent in formability or the like, and excellent in pressure resistance or the like in retort sterilization.

Means for Solving the Problems

The present inventors have achieved the present invention by taking note of facts that a radius of curvature of a corner portion provided between an inner peripheral side of an annular concave portion protruding to an inside of the can and a flat center panel on a can bottom has a major impact on flatness of the center panel and formability and that variation in the flatness of the center panel is evened out to be able to obtain a seamless can body excellent in suitability for the internal pressure test and formability by setting the radius of curvature to an appropriate value.

According to the invention, provided is a seamless can body having a can bottom shape comprising: a rim portion protruding to an outside of the can; an annular concave portion adjacent to an inner side of the rim portion and protruding to an inside of the can; and a center panel extending continuously from an inner peripheral side of the annular concave portion with a corner portion interposed therebetween, and being flat, wherein a radius $R_3$ of curvature of the corner portion is in a range of 1.5 mm$<R_3\leq$6.0 mm, a depth of the annular concave portion is equal to or greater than 1.5 mm and smaller than 3.0 mm, and flatness (BSD) of the center panel is −0.15 to 0.15 mm.

Further, in the seamless can body according to the invention, it is preferable that:

1. the seamless can body is formed by an aluminum plate and a thickness of the can bottom is 0.2 mm to 0.4 mm;

2. the seamless can body is formed by a steel plate and a thickness of the can bottom is 0.1 mm to 0.3 mm;

3. the seamless can body is for a slightly-positive-pressure can; and 4. the seamless can body is a seamless can body with at least an inner surface covered with resin.

Effects of Invention

According to the seamless can body in the invention, it is possible to obtain the seamless can body capable of maintaining high flatness of the center panel of the can bottom and excellent in the suitability for the internal pressure test and the formability and excellent in the pressure resistance. Furthermore, the decrease in the thickness of the annular concave portion of the can bottom can be prevented and a crack and a cut can be prevented. Especially in the seamless can body having the inner surface covered with resin, damage to the resin at the annular concave portion can be prevented.

BRIEF DESCRIPTION OF DRAWINGS

FIG. 1 is a sectional view showing a can bottom shape of a seamless can body according to the present invention.

FIG. 2 is an enlarged view of an essential portion of the can bottom shape of the seamless can body according to the invention.

EXPLANATION OF NUMERALS

Figure 3:
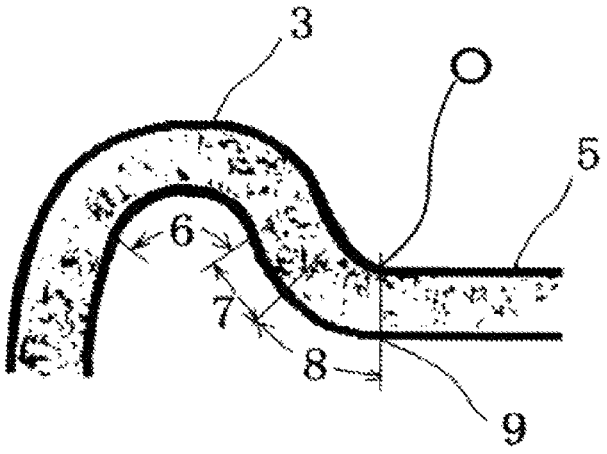
FIG. 3 is an enlarged view of an annular concave portion and a corner portion (panel edge) of the can bottom shape of the seamless can body according to the invention.

1 Seamless can body
2 Rim portion
3 Annular concave portion
5 Center panel
6 Arc-shaped portion of annular concave portion
7 Straight portion
8 Corner portion
9 Starting point
10 Resin

DESCRIPTION OF EMBODIMENTS

A seamless can body according to the present invention will be described below in detail based on the drawings.

The seamless can body 1 according to the invention is a seamless can body formed by a metal plate made of aluminum, tin, tin-free steel, or the like or a seamless can body formed by a covered metal plate formed by covering at least one surface of the metal plate on an inner side of the can body with a resin film made of polyester or the like.

As shown in FIG. 1, the can bottom of the seamless can body 1 according to the invention is formed by a rim portion 2 protruding to an outside of the can, an annular concave portion 3 extending continuously from and adjacent to an upper end of an inner wall of the rim portion 2 and recessed to the inside of the can, and a flat center panel 5 extending continuously from an inner wall side of the annular concave portion 3 with a corner portion (center panel edge) 8 interposed therebetween.

As shown in FIGS. 2 and 3, in a can bottom shape of the seamless can body 1 according to the invention, a shape of a connection between the annular concave portion 3 and the center panel 5 is such that a lower end portion of the rim portion 2 is an arc portion having a radius $R_1$ of curvature, that an upper end portion of the annular concave portion 3 is an arc portion 6 having a radius $R_2$ of curvature, and that the annular concave portion 3 and the panel edge of the center panel 5, i.e., the corner portion 8 having a radius $R_3$ of curvature are connected by a straight portion 7. A starting point 9 of the arc of the corner portion 8 where the corner portion 8 and the flat face of the center panel 5 are connected is an outer peripheral end of the center panel 5.

In the seamless can body 1 according to the invention, by setting the radius $R_3$ of curvature of the corner portion 8 between the annular concave portion 3 and the center panel 5 on the can bottom in a range of 1.5 mm$<R_3\leq$6.0 mm, it is possible to obtain the seamless can body excellent in flatness of the center panel, pressure resistance, and formability as shown in the example described later.

As is clear from the example described later, if the radius $R_3$ of curvature of the corner portion 8 is 1.5 mm or smaller, an excessive tensile load is applied to the corner portion 8 or a portion near the corner portion 8 during forming of the can bottom to cause constriction of thickness (decrease in thickness) at a portion in the circumferential direction of the corner portion and therefore the tensile load applied to the center panel becomes non-uniform in the circumferential direction. As a result, the flatness of the center panel is impaired and increase in a decrease rate of the thickness of the annular concave portion 3 and a crack or a cut are likely to occur. Such phenomena becomes noticeable especially when the seamless can body is made thin-walled.

On the other hand, if the radius $R_3$ of curvature exceeds 6.0 mm, a diameter of the center panel becomes small and responsivity of a panel swelling amount to can inner pressure becomes small and, as a result, suitability for an internal pressure test and the pressure resistance are likely to decrease. Therefore, by setting the radius $R_3$ of curvature of the corner portion 8 in the range of 1.5 mm$<R_3\leq$6.0 mm and preferably in a range of 2.0 mm$<R_3\leq$4.0 mm, it is possible to obtain the seamless can body having increased flatness of the center panel and excellent in the suitability for the internal pressure test and the formability.

Moreover, a distance (bottom sink) (BS) from a ground contact surface of the rim portion 2 of the can body to the center panel 5 is preferably in a range of 1.0 mm to 5.0 mm. If the bottom sink (BS) is under than 1.0 mm, the center panel 5 may protrude further downward than the rim portion 2 to impair a self-standing property when inner pressure increases. On the other hand, the distance exceeding 5.0 mm is not preferable because it causes decrease of an inner capacity of the can body and increase of an amount of metal materials to be used as can materials.

Moreover, a distance (bottom counter sink) (CS) from the ground contact surface of the rim portion 2 to the arc portion 6 having the radius $R_2$ of curvature of the annular concave portion 3 is preferably in a range of 1.0 mm to 8.0 mm. If the (CS) is shorter than 1.0 mm, the pressure resistance decreases. On the other hand, the (CS) exceeding 8.0 mm is not preferable, because the forming becomes difficult and a forming defect such as a crack occurs.

The radius $R_2$ of curvature of the annular concave portion 3 is preferably in a range of 0.5 mm to 2.0 mm. The ($R_2$) smaller than 0.5 mm is not preferable, because the forming becomes difficult and the forming defect such as the crack occurs. On the other hand, the ($R_2$) exceeding 2.0 mm is not preferable, because the pressure resistance decreases.

Because the annular concave portion 3 performs an important function of increasing the pressure resistance of the can bottom of the seamless can body 1 in the seamless can body 1 according to the invention, a depth (CS-BS) of the annular concave portion 3 is preferably equal to or greater than 1.5 mm and smaller than 3.0 mm in terms of the pressure resistance and the formability especially in a case in which the invention is applied to the above-described slightly-positive-pressure can formed by filling and sealing the can after replacing the head space with the inert gas such as nitrogen. This range is preferable, because the pressure resistance in the retort sterilization or the like decreases when the depth is smaller than 1.5 mm and the forming defect such as the crack of the annular concave portion 3 occurs in forming when the depth is 3.0 mm or greater.

The radius $R_1$ of curvature of the arc portion of the rim portion 2 contributes to increase of stability of contact with the ground and contributes, together with the annular concave portion 3, to increase of the pressure resistance. The radius $R_1$ is preferably in a range of 0.5 mm to 2.0 mm, because the forming becomes difficult and processing pressure in the forming increases to cause the crack or the cut when the radius $R_1$ is smaller than 0.5 mm and the pressure resistance decreases when the radius $R_1$ exceeds 2.0 mm.

The seamless can body according to the invention is applied to the seamless can body having the can bottom of the above-described thickness and formed by using a metal plate of a thickness of 0.2 mm to 0.4 mm when the metal plate is an aluminum plate and by using a metal plate of a thickness of 0.1 mm to 0.3 mm when the metal plate is a steel plate made of tin or tin-free steel.

Especially, the seamless can body according to the invention is applied to the seamless can body having a can body diameter of 53 mm to 66 mm (commonly referred to as a 202 diameter to 211 diameter can body).

The seamless can body according to the invention is intended to improve the suitability for the internal pressure test of the negative-pressure can or the slightly-positive-pressure can filled with low-acid beverage or the like and sealed and is especially suitable for the purpose of preventing damage to the resin film on the above-described corner portion or near the corner portion and deterioration of the content in flavor or occurrence of corrosion caused by exposure of the metal face in the seamless can body formed by drawing/ironing or wall-thinning drawing (stretch drawing)/ironing the covered plate obtained by covering at least one surface of metal material which is on an inner surface of the can body with resin such as polyester resin.

EXAMPLES

Evaluation

1. Flatness (BSD)

A distance (mm) of the center portion of the center panel bulging outward or inward from a basis surface (0) which was the outer peripheral edge of the center panel of the can bottom was measured and defined as the flatness (BSD). The flatness was evaluated as follows.

○: $-0.15 \leq BSD \leq 0.15$ x: $BSD < -0.15$ or $BSD > 0.15$

2. Pressure Resistance

In the present example, the pressure resistance was evaluated by using 490 kPa as a standard value in order to pass 470 kPa which was the standard of the pressure resistance against buckling of the can bottom in the retort sterilization based on the premise that the seamless can body would be used as the slightly-positive-pressure can.

3. Formability

The formability was evaluated by visually checking a decrease rate of the thickness of the straight portion 7 (between the center panel 5 and the annular concave portion 3) provided between the corner portion 8 of the center panel and the arc-shaped portion 6 of the annular concave portion 3 on the can bottom and presence or absence of a forming defect such as a cut (bottom crack) in the can bottom.

○: No bottom crack, the decrease rate of the thickness was less than 10%

Δ: No bottom crack, the decrease rate of the thickness was 10% or greater x: Occurrence of the bottom crack

[Manufacturing of the Seamless Can Body]

Figure 4:
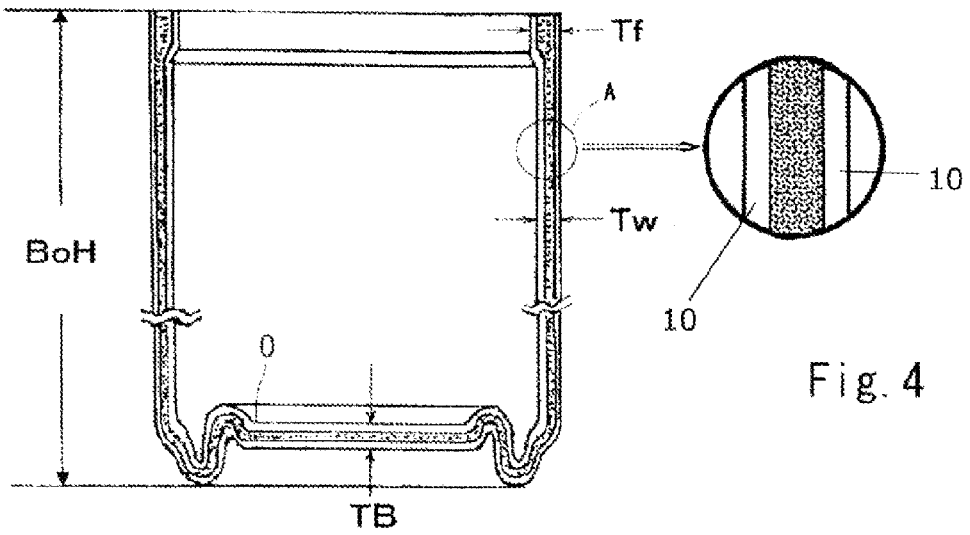
FIG. 4 is a sectional view showing a can bottom shape of a seamless can body according to the present invention, including an enlarged view illustrating an inner surface of the seamless can body.

A circular blank having a diameter of 128 mm was formed by using a laminated plate formed by covering both sides surface of an aluminum metal plate having a thickness of 0.25 mm with a polyester film having a thickness of 16 μm and the circular blank was drawn by using a cupping press into a cup having a body diameter of 73 mm and a height of 40 mm. Then, after redrawing/ironing the cup at a forming speed of 250 spm, an end portion of the cup was trimmed to obtain a seamless can body having a can body thickness (Tw) of 0.105 mm, a thickness of a can body end portion (Tf) of 0.175 mm, a can bottom thickness (TB) of 0.28 mm, and a can body height (BoH) of 143 mm. According to the embodiment illustrated in FIG. 4, the can body have an inner surface and outer surface covered with resin 10.

EXAMPLES

The seamless can bodies having radiuses $R_3$ of curvature of corner portions of the can bottoms of 1.5 mm, 2.0 mm, 4.0 mm, 6.0 mm, and 7.0 mm and depths (CS-BS) of annular concave portions of 1.0 mm, 1.5 mm, 2.1 mm, 2.8 mm, and 3.0 mm were manufactured respectively.

The seamless can bodies having the radiuses $R_3$ of curvature of the corner portions of the can bottoms of 2.0 mm to 6.0 mm which were in the range of $1.5\ mm < R_3 \leq 6.0\ mm$ and the depths (CS-BS) of the annular recessed portions of 1.5 mm, 2.1 mm, and 2.8 mm which were in the range of $1.5\ mm \leq (CS\text{-}BS) < 3.0\ mm$ were evaluated as respective examples and the seamless can bodies having the radiuses $R_3$ of curvature and the depths (CS-BS) of the annular recessed portions which were out of the ranges were evaluated as respective comparative examples.

Evaluation results of the examples are shown in Table 1 and evaluation results of the comparative examples are shown in Table 2.

In Table 2, "Not Evaluated" means that the flatness, the pressure resistance, and the thickness decrease rates for the formability were not evaluated because a crack was produced in the can bottom of the obtained seamless can body and the seamless can body was not even in a shape of the seamless can body.

TABLE 1

| | Corner Portion $R_3$ (mm) | Depth of Annular Concave Portion (CS-BS) (mm) | Evaluation | | | | | | | |
|---|---|---|---|---|---|---|---|---|---|---|
| | | | Flatness of Center Panel (BSD) (mm) | | Pressure Resistance (kPa) | | Formability | | | |
| | | | | | | | Decrease in Thickness (Corner Portion) (%) | Decrease in Thickness (Between Panel and Annular Concave (%) Portion) | Crack | Evaluation of Formability |
| Example 1 | 2.0 | 1.5 | 0.13 | ○ | 515 | ○ | 4.9 | 4.4 | None | ○ |
| Example 2 | 2.0 | 2.1 | 0.10 | ○ | 567 | ○ | 5.6 | 5.0 | None | ○ |
| Example 3 | 2.0 | 2.8 | 0.07 | ○ | 605 | ○ | 8.1 | 8.5 | None | ○ |
| Example 4 | 4.0 | 1.5 | 0.10 | ○ | 502 | ○ | 3.2 | 2.6 | None | ○ |
| Example 5 | 4.0 | 2.1 | 0.08 | ○ | 530 | ○ | 4.1 | 4.1 | None | ○ |
| Example 6 | 4.0 | 2.8 | 0.06 | ○ | 569 | ○ | 6.8 | 7.4 | None | ○ |
| Example 7 | 6.0 | 1.5 | 0.09 | ○ | 491 | ○ | 2.8 | 1.9 | None | ○ |
| Example 8 | 6.0 | 2.1 | 0.07 | ○ | 511 | ○ | 3.3 | 3.0 | None | ○ |
| Example 9 | 6.0 | 2.8 | 0.05 | ○ | 522 | ○ | 6.1 | 7.0 | None | ○ |

TABLE 2

| | Corner Portion $R_3$ (mm) | Depth of Annular Concave Portion (CS-BS) (mm) | Evaluation | | | | | | | |
|---|---|---|---|---|---|---|---|---|---|---|
| | | | Flatness of Center Panel (BSD) (mm) | | Pressure Resistance (kPa) | | Formability | | | |
| | | | | | | | Decrease in Thickness (Corner Portion) (%) | Decrease in Thickness (Between Panel and Annular Concave (%)Portion) | Crack | Evaluation of Formability |
| Comparative Example 4 | 1.5 | 2.8 | 0.10 | ○ | 625 | ○ | 12.4 | 10.8 | None | Δ |
| Comparative Example 5 | 1.5 | 3.0 | Not evaluated | | | | | | Present | x |
| Comparative Example 6 | 2.0 | 1.0 | 0.15 | ○ | 470 | x | 4.0 | 3.2 | None | ○ |
| Comparative Example 7 | 2.0 | 3.0 | 0.05 | ○ | 630 | ○ | 10.8 | 13.5 | None | Δ |
| Comparative Example 8 | 4.0 | 1.0 | 0.13 | ○ | 443 | x | 2.8 | 2.5 | None | ○ |
| Comparative Example 9 | 4.0 | 3.0 | 0.05 | ○ | 575 | ○ | 8.9 | 12.4 | None | Δ |
| Comparative Example 10 | 6.0 | 1.0 | 0.13 | ○ | 435 | x | 2.1 | 1.4 | None | ○ |
| Comparative Example 11 | 6.0 | 3.0 | 0.05 | ○ | 549 | ○ | 7.3 | 11.3 | None | Δ |
| Comparative Example 12 | 7.0 | 1.0 | 0.13 | ○ | 430 | x | 2.0 | 1.0 | None | ○ |
| Comparative Example 13 | 7.0 | 1.5 | 0.09 | ○ | 476 | x | 2.7 | 1.7 | None | ○ |
| Comparative Example 14 | 7.0 | 2.1 | 0.07 | ○ | 482 | x | 2.9 | 2.5 | None | ○ |
| Comparative Example 15 | 7.0 | 2.8 | 0.05 | ○ | 488 | x | 5.2 | 6.4 | None | ○ |
| Comparative Example 16 | 7.0 | 3.0 | 0.05 | ○ | 521 | ○ | 6.5 | 10.2 | None | Δ |

As a result, it was found that the flatness of the can bottom, the pressure resistance, and the formability can be increased by satisfying the conditions that the radius $R_3$ of curvature of the corner portion connected to the annular concave portion protruding to the inside of the can on the can bottom of the seamless can body is in the range of $1.5\ mm<R_3\leq 6.0\ mm$ and that the depth of the annular concave portion is equal to or greater than 1.5 mm and smaller than 3.0 mm.

INDUSTRIAL APPLICABILITY

The seamless can body according to the invention can adapt to the internal pressure test for the negative-pressure can and the slightly-positive-pressure can and especially for the slightly-positive-pressure can by maintaining high flatness of the center panel of the can bottom, has the increased pressure resistance and formability, and therefore has wide industrial applicability.

The invention claimed is:

1. A seamless can body having a can bottom shape comprising:

a rim portion protruding to an outside of the can;

an annular concave portion adjacent to an inner side of the rim portion and protruding to an inside of the can; and a center panel extending continuously from an inner peripheral side of the annular concave portion with a corner portion interposed therebetween, and being flat, wherein a radius $R_3$ of curvature of the corner portion is in a range of 1.5 mm$<R_3\leq$6.0 mm, a depth of the annular concave portion is equal to or greater than 1.5 mm and smaller than 3.0 mm, and flatness (BSD) of the center panel is −0.15 to 0.15 mm, and an outside diameter of said seamless can body is 53 mm to 66 mm.

2. The seamless can body according to claim 1, wherein the seamless can body is formed by an aluminum plate and a thickness of the can bottom is 0.2 mm to 0.4 mm.

3. The seamless can body according to claim 1, wherein the seamless can body is formed by a steel plate and a thickness of the can bottom is 0.1 mm to 0.3 mm.

4. The seamless can body according to any of claims 1 to 3, wherein the seamless can body is for a lightly-positive-pressure can.

5. The seamless can body according to any of claims 1 to 3, wherein the seamless can body is a seamless can body with at least an inner surface covered with resin.

* * * * *